US009151289B2

(12) United States Patent
Crofts et al.

(10) Patent No.: US 9,151,289 B2
(45) Date of Patent: Oct. 6, 2015

(54) FUEL PUMP

(75) Inventors: John D. Crofts, Edinburgh, IN (US); Scott R. Simmons, Simpsonville, SC (US); Wesley R. Thayer, Columbus, IN (US); Bela Doszpoly, Columbus, IN (US); David M. Rix, Columbus, IN (US); Anthony A. Shaull, Columbus, IN (US); David L. Buchanan, Westport, IN (US)

(73) Assignee: Cummins Inc., Columbus, IN (US)

( * ) Notice: Subject to any disclaimer, the term of this patent is extended or adjusted under 35 U.S.C. 154(b) by 1019 days.

(21) Appl. No.: 12/195,550

(22) Filed: Aug. 21, 2008

(65) Prior Publication Data

US 2010/0043760 A1 Feb. 25, 2010

(51) Int. Cl.

| | |
|---|---|
| ***F04B 53/02*** | (2006.01) |
| ***F04B 53/14*** | (2006.01) |
| ***F02M 59/10*** | (2006.01) |
| ***F04B 1/04*** | (2006.01) |
| ***F02M 59/44*** | (2006.01) |

(52) U.S. Cl.

CPC ..... *F04B 53/143* (2013.01); *F02M 59/102* (2013.01); *F02M 59/442* (2013.01); *F04B 1/0408* (2013.01); *F04B 1/0421* (2013.01); *F04B 1/0448* (2013.01); *F04B 53/14* (2013.01)

(58) Field of Classification Search

CPC .... F04B 1/0408; F04B 1/0421; F04B 1/0443; F04B 1/0448; F04B 53/14; F04B 53/143; F02M 59/442

USPC ..... 417/63, 470, 434, 435; 137/559, 558; 141/95

See application file for complete search history.

(56) References Cited

U.S. PATENT DOCUMENTS

| | | | | |
|---|---|---|---|---|
| 2,612,116 | A | 9/1952 | Lowther, Sr. | |
| 3,019,739 | A | 2/1962 | Prosser | |
| 3,623,053 | A * | 11/1971 | Meyer | 137/558 |
| 3,742,822 | A | 7/1973 | Talbert | |
| 4,233,886 | A | 11/1980 | Balzano et al. | |
| 4,399,997 | A | 8/1983 | Broken | |
| 4,640,308 | A | 2/1987 | Toelle | |

(Continued)

FOREIGN PATENT DOCUMENTS

| | | |
|---|---|---|
| EP | 1 355 059 A2 | 10/2003 |
| JP | 04-353262 A | 12/1992 |

(Continued)

OTHER PUBLICATIONS

PCT International Search Report with mailing date of Apr. 5, 2010; International application No. PCT/US2009/054429.

(Continued)

*Primary Examiner* — Bryan Lettman
*Assistant Examiner* — Charles Nichols
(74) *Attorney, Agent, or Firm* — Faegre Baker Daniels LLP

(57) ABSTRACT

A fuel pump is disclosed wherein a substantially cylindrical plunger bore is provided with an annular drain groove fluidically coupled to a drain duct. A pump plunger is driven by a drive system located in a separate mechanical compartment that holds a reservoir of lubricating oil. An annular seal is provided adjacent the drain groove substantially at the end of the bore and retained in position by a seal support. Exemplary embodiments provide the drain groove and seal as being positioned immediately adjacent one another so that the seal forms a lower wall of the drain groove.

7 Claims, 3 Drawing Sheets

(56) References Cited

U.S. PATENT DOCUMENTS

| | | | | | |
|---|---|---|---|---|---|
| 5,111,736 | A | | 5/1992 | Buchberger et al. | |
| 5,271,361 | A | * | 12/1993 | Flynn | 123/198 A |
| 5,403,169 | A | | 4/1995 | Yokoi et al. | |
| 5,469,704 | A | * | 11/1995 | Kramer | 60/455 |
| 5,501,255 | A | * | 3/1996 | Tortu et al. | 141/95 |
| 5,517,973 | A | | 5/1996 | Askew et al. | |
| 5,775,203 | A | | 7/1998 | Osborn et al. | |
| 5,983,863 | A | | 11/1999 | Cavanagh et al. | |
| 6,116,870 | A | * | 9/2000 | Kraemer | 417/490 |
| 6,135,734 | A | * | 10/2000 | Isozumi et al. | 417/542 |
| 6,138,643 | A | | 10/2000 | Oguchi et al. | |
| 6,725,876 | B2 | * | 4/2004 | Bowman et al. | 137/312 |
| 7,604,462 | B2 | * | 10/2009 | Inoue | 417/53 |
| 7,607,383 | B2 | * | 10/2009 | Nagel | 92/165 R |
| 7,610,927 | B2 | * | 11/2009 | Schmitz | 137/1 |
| 7,635,257 | B2 | | 12/2009 | Inoue | |
| 7,665,976 | B2 | * | 2/2010 | Usui et al. | 417/470 |
| 7,748,416 | B2 | * | 7/2010 | Bender et al. | 141/95 |
| 7,819,107 | B2 | * | 10/2010 | Stockner et al. | 123/445 |
| 7,896,023 | B2 | * | 3/2011 | Oelerich | 137/312 |
| 7,941,996 | B2 | * | 5/2011 | Bovina et al. | 60/378 |
| 8,052,404 | B2 | * | 11/2011 | Inoue | 417/505 |
| 8,052,405 | B2 | * | 11/2011 | Inoue | 417/505 |
| 2003/0017069 | A1 | * | 1/2003 | Usui et al. | 417/571 |
| 2004/0052664 | A1 | * | 3/2004 | Saito et al. | 417/490 |
| 2004/0096346 | A1 | * | 5/2004 | Usui et al. | 417/470 |
| 2006/0159555 | A1 | * | 7/2006 | Inoue | 417/297 |
| 2006/0228239 | A1 | * | 10/2006 | Usui et al. | 417/470 |

FOREIGN PATENT DOCUMENTS

| | | | |
|---|---|---|---|
| JP | 10-184494 | A | 7/1998 |
| JP | 2003-314408 | A | 11/2003 |
| JP | 2005-133681 | A | 5/2005 |
| JP | 2006-200407 | A | 8/2006 |

OTHER PUBLICATIONS

PCT Written Opinion of the International Searching Authority with mailing date of Apr. 5, 2010; International application No. PCT/US2009/054429.

* cited by examiner

FUEL PUMP

BACKGROUND

1. Field of the Invention

The present invention relates to fuel pumps for supplying fuel to internal combustion engines. More particularly, the present invention relates to a fuel pump having a plunger bore and seal configured to facilitate an increase in the pressurized region along the length of the pump plunger bore.

2. Description of the Related Art

Today's engine designers must meet the challenge of government mandated emissions criteria while striving to improve engine fuel efficiency. In rising to this challenge, designers create fuel systems that operate at higher pressures than systems of the past. In so doing, greater performance demands are placed on fuel pump components and operations. Fuel pumps typically include a pump plunger positioned in the bore of a fuel pump barrel and sized so as to permit reciprocating motion within the bore. Pump plungers are driven by a drive system positioned in a separate mechanical compartment supplied with lubricating oil. Because the plunger diameter must necessarily be less than the bore diameter, fuel leakage in the resulting space can occur. Fuel escapes from the fuel pumping chamber and passes along the clearance space between plunger and bore, then is available to leak into the drive compartment. Such fuel leakage contaminates the engine lube oil and causes a reduction in the oil's viscosity, thus shortening its life and effectiveness.

To address the problem of fuel leakage, traditional engine designs provide a drain groove located in the plunger bore between the pumping chamber and the end of the bore opposite the pumping chamber. The portion of the bore between the pumping chamber and drain groove provides a high-pressure seal by virtue of the close tolerance between plunger and bore diameters. Fuel leaking through the clearance area above the drain groove is collected by the drain groove and diverted to a fuel drain circuit. The portion of the bore between the drain groove and the bore end opposite the pumping chamber is formed as an annular clearance gap between the barrel and plunger, and serves to separate the drain groove from the lube oil. To prevent fuel flowing out of the drain groove along the bore in the clearance between the barrel and the plunger from reaching the lube oil, some traditional pump designs provide a back-up seal. The back-up seal also serves to inhibit lube oil from entering the fuel chamber. However, this approach has the disadvantage of pressure spikes occurring due to dilation of the plunger under axial load. Such pressure spikes hinder the operation of the seal. Accordingly, what is needed is a fuel pump that can provide adequate pressurization to meet modern design standards yet employ a sealing system that satisfactorily preserves the integrity of both the fuel and lube oil areas.

SUMMARY

The present invention has been developed to address the above and other problems in the related art. According to some embodiments of the present invention, a fuel pump is provided that comprises a fuel pump barrel including a bore having first and second ends separated by a length of bore, the second bore end forming an opening. The fuel pump barrel also includes an annular drain groove within the bore, spanning the bore's circumference, and a drain duct that is fluidically coupled to the drain groove. A plunger is provided that has an outer diameter that is slightly less than the bore diameter, forming a clearance that facilitates reciprocating movement within the bore. The plunger is positioned in the bore and extends through the bore opening to form a pumping chamber. An annular seal is provided that is positioned adjacent to the drain groove and located substantially at the second end of said bore. A seal support aids to retain the seal in position.

According to another embodiment, a cooling duct is provided within the fuel pump barrel so that cooling fuel can flow through the fuel pump barrel to the drain groove and exit via the drain duct. Thus, pressurized leakage fuel can travel within the clearance between the bore and plunger with decreasing pressure gradient from the first end of the bore to the drain groove, mix with the cooling fuel, and evacuate with the cooling fuel through the drain duct.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The above and/or other exemplary features and advantages of the preferred embodiments of the present invention will become more apparent through the detailed description of exemplary embodiments thereof with reference to the accompanying drawings, in which.

Throughout the drawings, like reference numbers and labels should be understood to refer to like elements, features, and structures.

DETAILED DESCRIPTION

Exemplary embodiments of the present invention will now be described more fully with reference to the accompanying drawings. The matters exemplified in this description are provided to assist in a comprehensive understanding of various embodiments of the present invention disclosed with reference to the accompanying figures. Accordingly, those of ordinary skill in the art will recognize that various changes and modifications of the embodiments described herein can be made without departing from the scope and spirit of the claimed invention. Descriptions of well-known functions and constructions are omitted for clarity and conciseness. To aid in clarity of description, the terms "upper," "lower," "above," "below," "left" and "right," as used herein, provide reference with respect to orientation of the accompanying drawings and are not meant to be limiting. The term "substantially" as used herein may be applied to modify any quantitative representation which could permissibly vary without resulting in a change in the basic function to which it is related.

Figure 1:
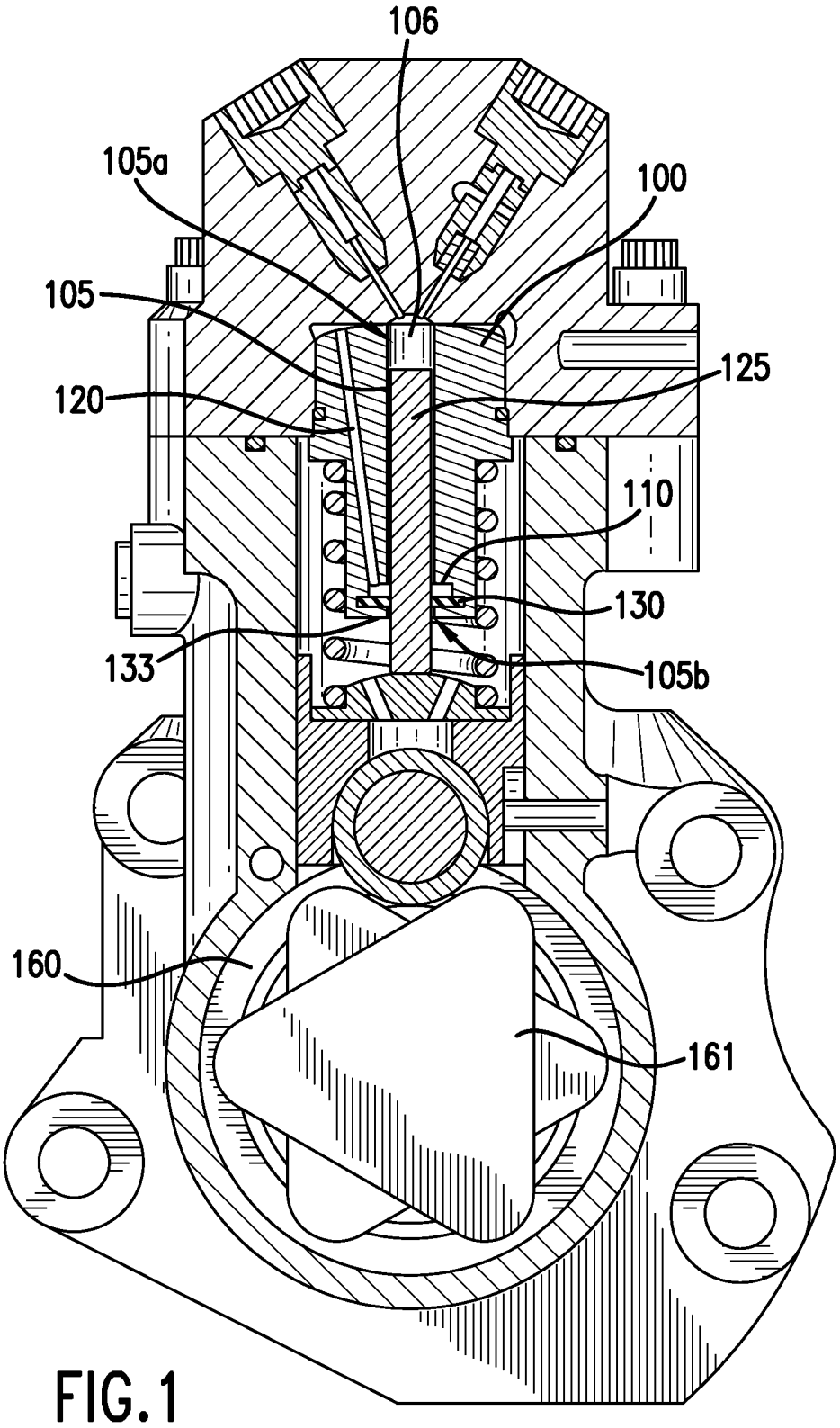
FIG. 1 illustrates a cross-sectional view of a fuel system in accordance with an embodiment of the present invention.

FIG. 1 illustrates a cross-sectional view of a fuel pump in accordance with an embodiment of the present invention. As will be described in detail below, a novel manner of sealing a reciprocating plunger that is capable of maintaining high pressures in a fuel pump is disclosed. The novel sealing of the present invention enhances fuel pump durability and reliability as compared to conventional fuel pumps.

Referring to FIG. 1 a fuel pump barrel 100 forms a substantially cylindrical bore 105 having a first end 105*a* and a second end 105*b* separated by a length of bore. First end 105*a* is substantially closed whereas second end 105*b* is open to permit insertion of plunger 125. That is, bore 105 forms an opening in barrel 100 at second end 105*b*. The fuel pump barrel 100 and associated materials may be constructed of any material that can withstand the pressures and heat of fluids processed therethrough. For example, heat treated steel or aluminum are suitable materials. Towards second end 105*b* of bore 105, an annular drain groove 110 is formed that spans the circumference of the bore. Drain groove 110 is fluidically coupled to a drain duct 120 that is routed within fuel pump barrel 100. Drain duct 120 may be coupled to a fuel drain circuit (not shown) that terminates at a fuel storage vessel (not shown). In this manner, leakage fuel evacuating through drain duct 120 can be recycled within the fueling system. In an exemplary embodiment the lower end of barrel 100 is cantilevered and free from support at bore second end 105*b*.

In an exemplary embodiment fuel pump barrel 100 comprises an integrated, one-piece unit; in an alternate embodiment fuel pump barrel 100 is formed of multiple sections coupled together by any means available to those of ordinary skill in the art, such as, for example, threading.

A reciprocating plunger 125 is mounted in bore 105 for reciprocal movement through compression and retraction strokes. Plunger 125 has an outer diameter that is slightly less than the inner diameter of bore 105 to form an annular clearance that permits reciprocating movement of the plunger within the bore while creating a partial fluid seal, thereby forming a seal length along the plunger between the plunger and bore, to permit pressurization of pumping chamber 106 during the compression stroke. Plunger 125 extends through the bore opening near second end 105*b* and into bore 105. The top end of plunger 125 within bore 105 serves to provide a boundary for fuel pumping chamber 106. Plunger 125 is driven by a drive system 161, such as a rotating cam and tappet assembly, located in a separate mechanical compartment 160 containing lubricating oil, such as disclosed in U.S. Pat. Nos. 5,775,203 and 5,983,863, each of which is hereby incorporated by reference in their entirety.

An annular seal 130 is provided for sealing plunger 125 within bore 105. Seal 130 abuts groove 110 and is located substantially at second end 105*b* of bore 105. In this position, seal 130 provides separation of fuel within the fuel pumping chamber 106 of bore 105 and space above groove 110 from lube oil within the mechanical compartment 160 containing drive system 161. Seal 130 can be made from any material known to those of ordinary skill in the art that is suitable for sealing in accordance with the present invention. In exemplary embodiments, seal 130 comprises PTFE-based materials with metal springs to energize the seal. Fluoroelastomers, such as Viton (R), can be used. Other embodiments employ metallic seals or seals comprising magnetic fluids (ferrofluids). Preferably, drain groove 110 and seal 130 are positioned immediately adjacent one another so that the upper face of seal 130 forms the lower wall of drain groove 110. In this exemplary embodiment, no portion of fuel pump barrel 100 extends between seal 130 and drain groove 110 to create a bore seal length. In an exemplary embodiment, the lower portion of the seal length opens into the seal.

Seal 130 is secured by seal support 133, which provides structure, such as a lip or ledge, upon which seal 130 is supported. Seal support 133 can be a plate that extends across the lower portion of the barrel and is secured to the barrel by a fastening mechanism as would be known to those of ordinary skill in the art. Seal support 133 can be positioned between seal 130 and the bore opening and establishes bore second end 105*b*. In an exemplary embodiment, seal support 133 is an integral portion of barrel 100 and is formed to retain seal 130 in position abutting drain groove 110. Alternatively, seal support 133 is a separate component, for example, a plate that extends across the lower portion of barrel 100, connected to barrel 100 by any means available to those of ordinary skill in the art, such as any conventional fastener or connector device, threading or compression fitting. Seal 130 may be coupled to support 133 to form a compound unit. In an exemplary embodiment, seal support 133 is annular and has an inner diameter larger than the inner diameter of bore 105. In alternate embodiments the inner diameter of seal support 133 can be equivalent to the inner diameter of bore 105. In an exemplary embodiment, seal support 133 is formed of just enough material to support seal 130. In an alternate embodiment, a separate element provides the seal support function and couples to bore 105 to support seal 130 and retain its position abutting drain groove 110.

During the compression stroke, plunger 125, operating above seal 130, is reciprocated deeper into bore 105 and the pressure and temperature within pumping chamber 106 increases. In this state, pressurized fuel in chamber 106 can flow or leak through the clearance between plunger 125 and bore 105. Additionally, because of the elevated temperature and pressure, fuel can vaporize, thus becoming susceptible to leaking through the clearance space. Leaking fuel vapor and fluid is captured by drain groove 110 for evacuation through drain duct 120. Because groove 110 and seal 130 are positioned substantially at second end 105*b* of bore 105, separated from the bore opening by seal support 133, the entire length of bore 105 from pumping chamber 106 to groove 110 can be devoted to high-pressure sealing. That is, the entire length of bore 105 from pumping chamber 106 to groove 110 forms a high-pressure seal length having a maximum length. Fuel pressure, which is highest in pumping chamber 106, decreases along the bore seal length from chamber 106 to drain groove 110 as leakage fuel and vapor travel down the clearance between plunger 125 and bore 105, thus providing a decreasing or negative pressure gradient. The fuel pressure in drain groove 110 is maintained at a low pressure level, that is, for example, drain pressure of 0-100 PSI, since fluid and vapor can escape from drain groove 110 into drain duct 120. In conventional fuel pumps, a non-pressurized bore length below the drainage groove is employed to separate the groove from lube oil. This requires, however, a larger clearance between plunger and bore in order to allow for plunger dilation during Poisson expansion of the plunger while under axial load, which causes pressure spikes during each pumping stroke. Such a larger clearance can permit fuel leakage into the lube oil and the pressure spikes stress the sealing system, thereby shortening its lifecycle. Thus, a smaller clearance, that is, a match fit, between plunger 125 and bore 105, along the length of bore 105 above the drain groove 110, can be used since the non-pressurized bore length below drain groove 110 is substantially eliminated. For example, traditional fuel pumps require a clearance of 5 microns above the drain groove but exemplary embodiments of the present invention, however, can employ a clearance of approximately 3 microns. By using seal 130 positioned at an opposite end of the bore farthest from the pumping chamber to provide fuel and lube oil separation, instead of a portion of plunger bore 105, substantially the entire length of plunger bore 105, that is, the seal length, can be devoted to efficient pumping enabled by the effective high pressure seal achieved by maximizing the seal length and forming the seal length from continuous uninterrupted surfaces free from, for example, another seal or drain passage that intervenes along its length. Thus, seal 130 need only function to separate fuel from lube oil at low pressure. Therefore, the sealing function (fuel/lube oil separation) is separated from the pumping function (high pressure fluid seal of the seal length) thereby minimizing fuel dilution and contamination from leaking lube oil, while also minimizing oil dilution and contamination from leaking fuel.

The dedicated high-pressure seal length in accordance with embodiments of the present invention provides an unexpected benefit to high-pressure pumping efficiency since the bore can be manufactured with less form error (because of the shorter length and absence of a groove to interrupt machining), which in turn can lead to a smaller pump size for a given engine power output, and may eliminate the need for a fuel cooler. For example, traditional fuel pumps require a bore length of 47 mm with a seal length of 24 mm. Exemplary embodiments of the present invention, however, employ a bore length of approximately 36 mm with a seal length that is the same, that is, approximately 36 mm.

Preferably, the high-pressure seal length is continuous or uninterrupted, that is, formed by opposing surfaces of the plunger and barrel free from drain grooves, drain or cooling flow ducts, or any other obstruction. Small grooves, however, may be desirable to provide a labyrinth seal. As a result, with the exception of the space occupied by the annular drain groove 110 and seal 130 at one end of the bore, the entire bore/plunger interface forms the high pressure seal length. In an alternate embodiment, however, a collection groove can be provided to capture fuel. Such a groove can aid in lubrication during reciprocation of plunger 125. In an exemplary embodiment, a fuel collection groove is fluidically coupled to a fuel flow duct.

In an exemplary embodiment, seal 130 comprises a first seal portion 131 and a second seal portion 132 such that first seal portion 131 seals the fuel-pump seal length, and second seal portion 132 seals the lube oil within the mechanical compartment 160 containing drive system 161. A cavity 134 is formed between the first and second seal portions that serves to collect fluid leaking from either seal portion. Such a dual seal configuration provides a mechanism to protect the pump and engine lube oil from contamination in the event of seal wear or failure. With dual seals, leakage bypassing either first 131 or second 132 seal portions can collect in the cavity between the two seal portions and drain externally via leakage duct 135 that is fluidically coupled to said cavity, which in one exemplary embodiment is formed within fuel pump barrel 100.

Leakage duct 135 can vent directly to ambient air or, optionally, can couple to a reservoir 140 for containing leakage fluid, which comprises fuel, lube oil, or a mixture of the two. Reservoir 140 can be formed of a graduated vessel with indication of maximum allowable leakage, an input port 141, a resealable drain valve 142, and an overflow vent 143. During normal engine service intervals, such as, for example, engine oil and filter changes, the quantity of leakage fluid is expected to be less than the volume of reservoir 140, and all leakage fluid should be contained therein. Any fluid in reservoir 140 should be drained at the time of regular engine service. The resealable drain valve 142 may be provided for this purpose. A maximum allowable leakage mark can be located on reservoir 140 to provide indication that either or both first 131 and second 132 seal portions have worn excessively and should be replaced. If either or both seals fail, the leakage flow can exceed the volume of reservoir 140 and will drain to ambient air via overflow vent 143. Optionally, a level sensor and alarm (not shown) can be provided for indicating leakage fluid level within reservoir 140 and providing a signal, for example, a visual, audible, and/or control signal, in the event of an overflow condition or filling of reservoir capacity.

In operation, fuel is supplied to the pumping chamber 106. During the compression stroke of plunger 125, reciprocating deeper into bore 105, the pressure and temperature of the fuel within pumping chamber 106 increases. A seal length is formed within the annular clearance between plunger 125 and bore 105. A small quantity of fuel, however, will escape pumping chamber 106 and the seal length. This leakage fuel, which can be partially vaporized, is collected at drain groove 110 and prevented from entering mechanical compartment 160 by seal 130. The leakage fuel is evacuated from drain groove 110 through drain duct 120. Exemplary embodiments provide cooling fuel to drain grove 110 to aid in fuel liquification and evacuation through drain duct 120. Drain duct 120 may be coupled to a fuel drain circuit that terminates at a fuel storage vessel to facilitate fuel recycling within the fueling system.

Figure 2:
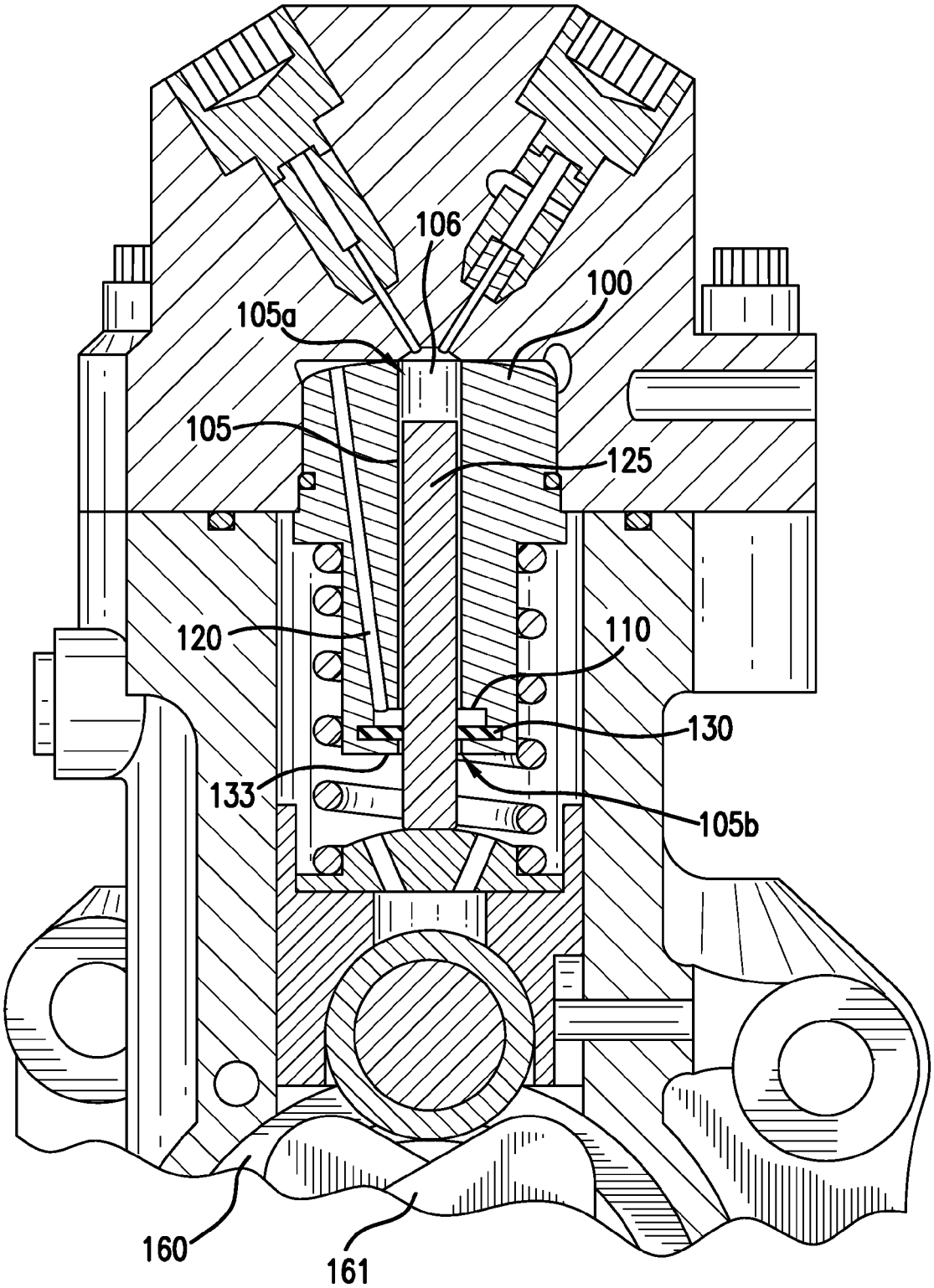
FIG. 2 illustrates a partial cross-sectional view of a fuel pump in accordance with an embodiment of the present invention.

FIG. 2 illustrates a partial cross-sectional view of a fuel pump in accordance with an embodiment of the present invention, providing an enlarged view of the bore, plunger, seal and drain groove.

Figure 3:
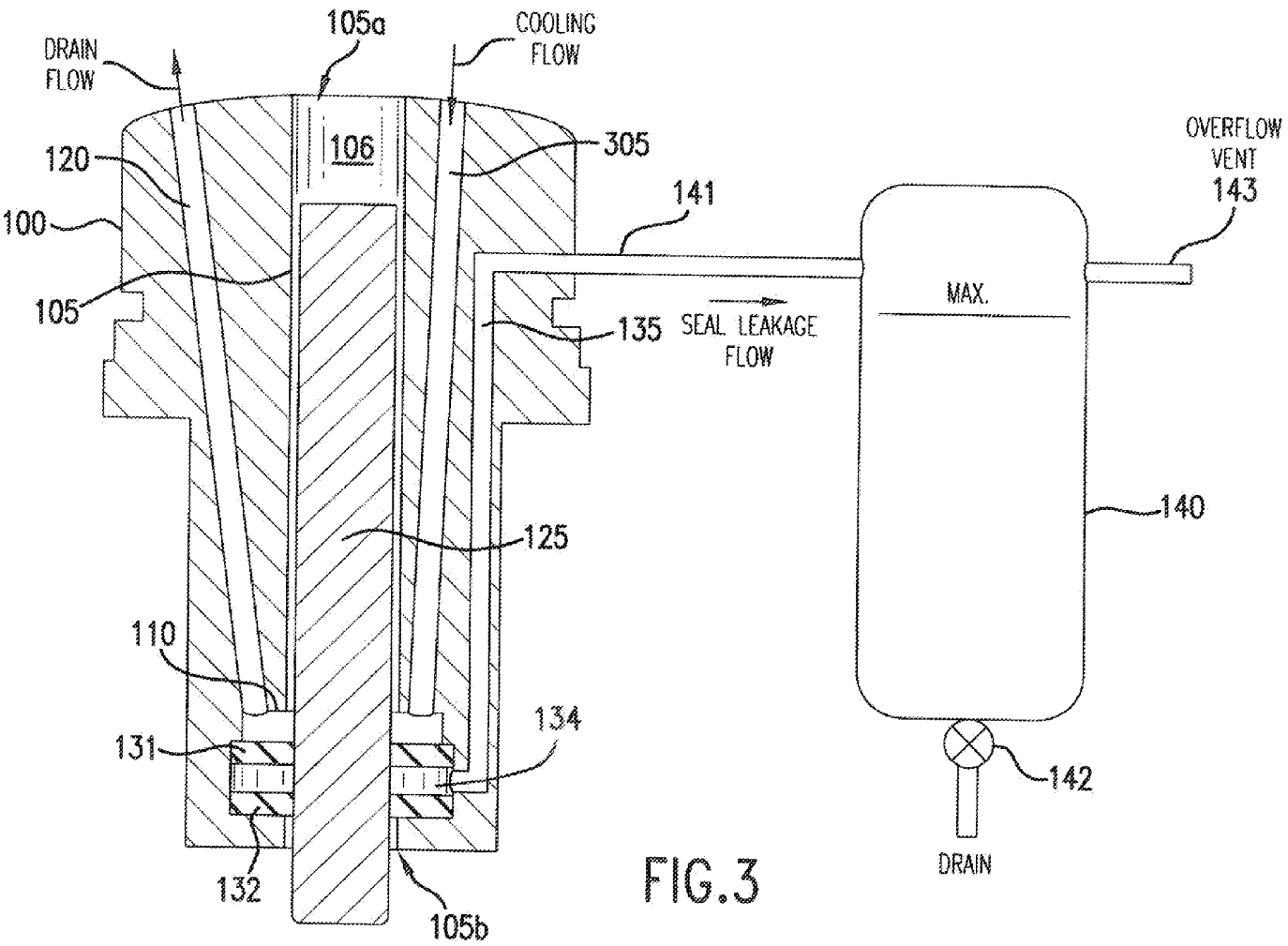
FIG. 3 illustrates a partial cross-sectional view of a fuel pump having cooling ducts in accordance with an embodiment of the present invention.

FIG. 3 illustrates a partial cross-sectional view of a fuel pump having cooling ducts in accordance with an embodiment of the present invention. The embodiment illustrated by FIG. 3 includes the embodiment disclosed in FIG. 1. Discussion of those elements here, however, will be omitted for clarity and conciseness. Referring to FIG. 3, a cooling duct 305 is provided within fuel pump barrel 100 to direct or deliver cooling fuel flow to drain groove 110. Cooling duct 150 transports cooling fuel to reduce thermal heating due to high pressure pumping, which in turn reduces thermal expansion. The cooling fuel is preferably supplied from low pressure supply fuel, for example, extracted from the downstream side of a low pressure pump (not shown) that supplies fuel to the fuel pump for delivery to the pumping chamber 106.

Fuel is routed to drain groove 110 via a transverse cooling duct 305, which fluidically couples to drain groove 110. Drain groove 110 collects fuel leakage passing through the clearance between plunger 125 and bore 105 during pumping. Because of the elevated temperature and pressure in pumping chamber 106, fuel can vaporize. Thus, the leakage fuel can be a mix of liquid and vapor. When the cooling fuel mixes with the leakage fuel in drain groove 110, the cooling effect of the cooling fuel can cause the leaking fuel to be maintained in the liquid state, which can be less harsh on seal 130 and plunger 125. In an exemplary embodiment, cooling flow passes along the outer diameter of fuel pump barrel 100 within an annular groove and concomitant fuel ducts forming cross passages to reduce barrel temperature.

Fuel within drain groove 110 is evacuated through drain duct 120 and can be returned to a fuel storage tank (not shown) via an intervening fuel containment system (not shown). A control valve (not shown) can be added to the cooling circuit and coupled to the cooling duct to block cooling fuel flow during engine cranking. Additionally, a transverse cross-passage cooling duct 305 can be provided within the fuel pump barrel 100. The transverse cross-passage cooling duct 307 can have an orifice (not shown) to limit the cooling fuel flow to a maximum amount. In embodiments where multiple fuel pumps in accordance with the present invention are provided, the drain duct of one fuel pump can couple to the input cooling duct of another fuel pump for continuation of cooling fuel flow through the system.

While the present invention has been particularly shown and described with reference to certain exemplary embodiments thereof, it will be understood by those of ordinary skill in the art that various changes in form and detail may be made therein without departing from the spirit and scope of the present invention as defined by the appended claims. For example, embodiments have been described in application of a pressurized fuel pump but are also capable of being employed in hydraulic motors receiving energy from a pressurized motive fluid.

What is claimed is:

1. A fuel pump, comprising:

a fuel pump barrel including a stepped region that transitions an upper portion to a smaller diameter lower portion and a spring disposed about at least a portion of the lower portion, said fuel pump barrel including a bore having first and second ends separated by a length of the bore, said fuel pump barrel including an annular drain groove positioned within the at least a portion of the lower portion, and a drain duct fluidically coupled between said drain groove and a fuel storage vessel, said second bore end forming an opening;

a plunger positioned in said bore and extending through said bore opening to form a pumping chamber, said plunger having an outer diameter slightly less than the bore diameter to form a clearance to facilitate reciprocating movement within said bore;

a first annular seal positioned adjacent said drain groove and located within the at least a portion of the lower portion between said annular drain groove and said opening to define a maximum seal length along the plunger between the pumping chamber and the annular drain groove;

a second annular seal positioned between said first annular seal and said opening forming a cavity between said first annular seal and said second annular seal;

a leakage fluid reservoir for receiving leakage fluid from said cavity;

a leakage duct fluidically coupled between said cavity and said leakage fluid reservoir; and a seal support configured to retain said first and second annular seals in position;

wherein the opening has a diameter that is less than a diameter of the annular drain groove; and wherein combined leakage fluid from said bore and leakage fluid from the pumping chamber in said cavity is drained to said leakage fluid reservoir by said leakage duct, and a cooling duct, formed by said fuel pump barrel, having a lower end which directly opens into the drain groove, and fluidically coupled to said drain groove, configured to permit fuel flow through the fuel pump barrel to the drain groove.

2. The fuel pump of claim 1, wherein said drain groove is substantially at drain pressure.

3. The fuel pump of claim 1, wherein said reservoir comprises a graduated vessel with indication of maximum allowable leakage, an input port, a resealable drain, and an overflow vent.

4. The fuel pump of claim 3, further comprising:

a level sensor and alarm for providing indication of leakage fluid level within said reservoir.

5. The fuel pump of claim 1, wherein said seal support comprises an annular structure having an inner diameter different from that of the bore.

6. The fuel pump of claim 1, wherein said first seal and said drain groove are positioned immediately adjacent one another so that the first seal forms a lower wall of the drain groove.

7. The fuel pump of claim 1, wherein the annular drain groove has a circumference along the length of the bore that is greater than the clearance between the bore diameter and the outer diameter of the plunger.

* * * * *